US007836625B2

(12) United States Patent
Swan et al.

(10) Patent No.: US 7,836,625 B2
(45) Date of Patent: Nov. 23, 2010

(54) LOW PROFILE MOUNT AND FOREGRIP FOR FIREARM

(75) Inventors: Johnny Swan, Virginia Beach, VA (US); William Swan, Monticello, AR (US)

(73) Assignee: S&S Precision, LLC, Monticello, AR (US)

( * ) Notice: Subject to any disclaimer, the term of this patent is extended or adjusted under 35 U.S.C. 154(b) by 0 days.

(21) Appl. No.: 12/287,129

(22) Filed: Oct. 6, 2008

(65) Prior Publication Data

US 2009/0100734 A1 Apr. 23, 2009

Related U.S. Application Data

(60) Provisional application No. 60/997,843, filed on Oct. 5, 2007.

(51) Int. Cl.
*F41G 1/387* (2006.01)

(52) U.S. Cl. ..... 42/127; 42/146

(58) Field of Classification Search ..... 42/114–117, 42/142, 146, 124–128
See application file for complete search history.

(56) References Cited

U.S. PATENT DOCUMENTS

| | | | | |
|---|---|---|---|---|
| 4,008,536 | A * | 2/1977 | Adams | 42/112 |
| 4,216,600 | A * | 8/1980 | Brueckner et al. | 42/127 |
| 6,499,245 | B1 * | 12/2002 | Swan | 42/71.01 |
| 6,785,997 | B2 * | 9/2004 | Oz | 42/94 |
| 7,444,776 | B2 * | 11/2008 | Adams | 42/127 |

* cited by examiner

*Primary Examiner*—Stephen M Johnson
(74) *Attorney, Agent, or Firm*—Speed Law Firm

(57) ABSTRACT

Embodiments include a method and apparatus for mounting one or more accessories to a rail of a firearm. A mounting member may be utilized for attaching the one or more accessories to the rail. Embodiments further include a method and apparatus for protecting a user from a discharging portion of a firearm. Some embodiments include a foregrip having a gripping portion and a guarding portion which may be used for protecting the user. In some embodiments, the guarding portion has a larger outer diameter than the gripping portion so that the guarding portion acts as a stop for the user's body parts.

2 Claims, 5 Drawing Sheets

LOW PROFILE MOUNT AND FOREGRIP FOR FIREARM

CROSS-REFERENCE TO RELATED APPLICATIONS

This application claims benefit of U.S. provisional patent application Ser. No. 60/997,843, filed Oct. 5, 2007, which is herein incorporated by reference.

BACKGROUND OF THE INVENTION

1. Field of the Invention

Embodiments generally relate to mounting accessories to a firearm and protecting a user's body parts from slipping around and in front of a firearm discharging end.

2. Description of the Related Art

From the perspective of looking down the length of the rifle, a rail or rail system of a rifle has four mounting surfaces that are located at the 12, 3, 6, and 9 o'clock positions. The positions in between are simply unused space, herein referred to as "dead space." These dead spaces are closer to the center axis of the rifle barrel than the rail system mounting surfaces. These dead spaces typically have through-holes which are in the form of small holes or slots.

Modern day breaching shotguns are often extremely short in length, which brings the position of the hand even closer to the end of the barrel, increasing the risk of injury to the user's hand and fingers. Additionally, these shotguns are often intentionally designed without a butt stock in order to remain compact and light weight. The butt stock channels the energy of the weapon being fired through the butt stock and into the shoulder of the person firing the shotgun. Regarding the violence of force happening while firing the shotgun without a butt stock and simultaneously pumping the action, there is an extreme risk to an individual's fingers, hand, or other body parts slipping around and in front of the barrel, resulting in injury to the individual.

There is therefore a need for a productive use of the dead space on a firearm. There is a further need for a safer firearm which more effectively prevents the user from injury due to body parts slipping in front of the discharge end of the firearm.

SUMMARY OF THE INVENTION

Embodiments generally include a mounting member for attaching one or more accessories to a firearm, comprising a body having a first end and a second end; one or more connecting portions capable of releasably connecting the mounting member to one or more ventilation holes through a rail of the firearm; and an accessory connecting portion to which one or more firearm accessories are capable of attaching.

Embodiments further generally include a foregrip for a firearm, comprising a gripping portion having a longitudinal bore therethrough which is capable of attaching to a firearm; and a guarding portion having a longitudinal bore therethrough which is capable of operative attachment to the gripping portion, the guarding portion having a greater outer diameter than an outer diameter of the gripping portion.

Embodiments also include a method for making and using the mounting member and a method for making and using the foregrip.

BRIEF DESCRIPTION OF THE DRAWINGS

So that the manner in which the above-recited features of embodiments of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
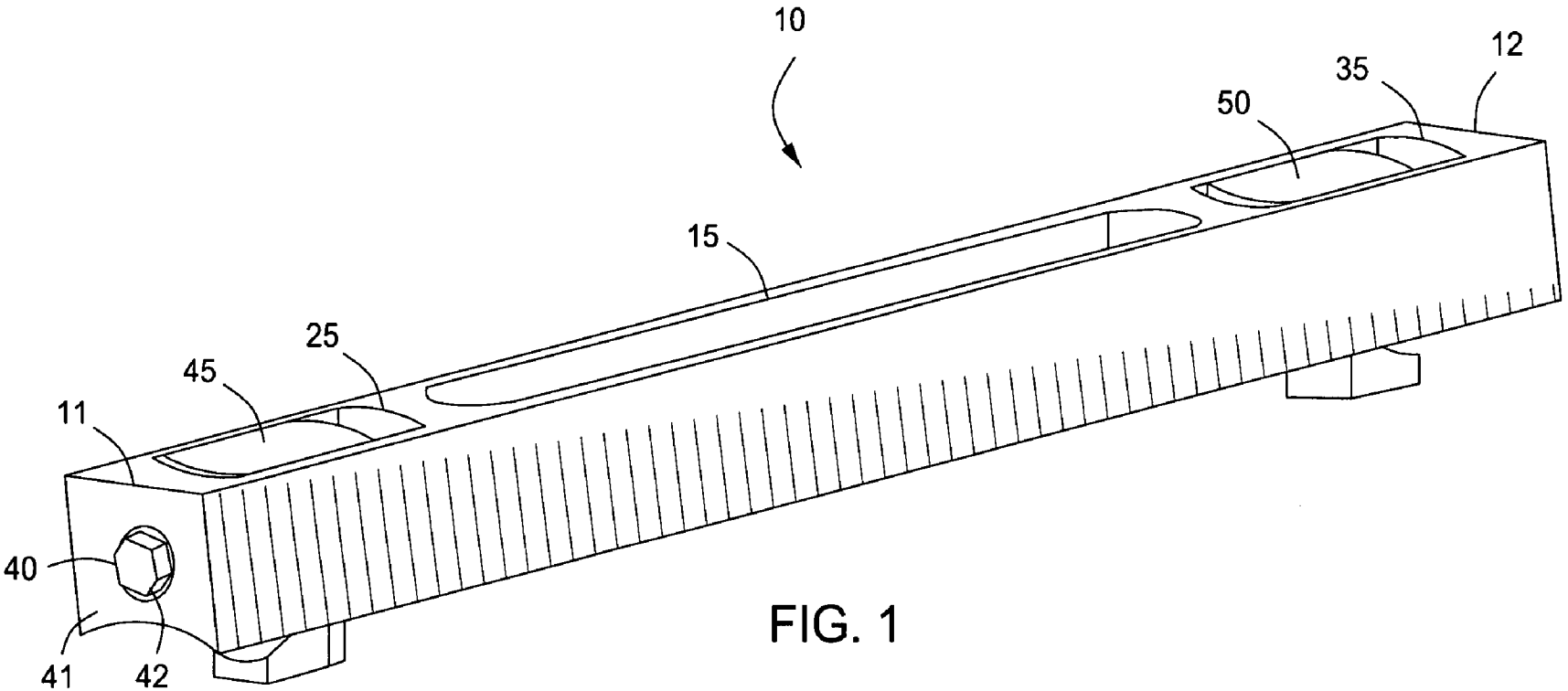
FIG. 1 is a perspective view of an embodiment of a mounting member or low profile mount.

FIGS. 1-5 show an embodiment of a mounting member or low profile mount. The exemplary current rail system's official title MIL-STD-1913 is a bracket used on most combat assault rifles in order to provide a standardized mounting platform for iron sights, telescopic sights, tactical lights, overt and IR laser systems, vertical grips, bipods, sling attachment points and/or other accessories. The standard was published by the Picatinny Arsenal and is also known to those skilled in the art as the Picatinny Rail, herein referred to as the rail or "rail system."

Embodiments provide a platform herein referred to as a mounting member or "low profile mount" that accepts one or multiple optional accessories to the dead space of the rail system at desired locations and with positional security. The mounting member or low profile mount may have slides, threaded holes, and/or other mounting fixtures suited to securing the accessories to the dead space. The low profile mount may be configured to present a relatively low-profile protrusion from the rail system using physical surfaces that offer low risk of snagging or being caught in external devices when accessories are not in place. Embodiments allow for adjustment of the position of the accessories when they are attached to the low profile mount, which desirably optionally accepts more than one optional accessory thereon.

The low profile mount may utilize an interface structure secured to the dead space of the rail system, providing surfaces for mounting accessories in a low-profile position. The mounting member or low profile mount may utilize one or more mechanisms that may grab and tension the side and back surfaces of the dead space. In some embodiments, the mounting member or low profile mount may be secured to the rail or rail system using existing through-holes with fasteners already employed or rivets, nuts and/or bolts which may be made, for example, from plastic (e.g., for light duty applications), stainless steel, forge-hardened steel, and/or any other suitable material known to those skilled in the art.

A benefit of this embodiment is that the mounting member or low profile mount may be added to already-manufactured rails or rail systems and optional accessories. If necessary or desired, modified fasteners, which may be longer than the standard fasteners, may be provided to secure both the mounting member or low profile mount and the optional accessories using the existing through-holes. Avoiding the need for additional through-holes to secure the low profile mount on the dead space means that the low profile mount may be attached by an individual or layman and does not require a qualified gunsmith for attachment.

The mounting member or low profile mount provides a solution for lack of rail space or overcrowded rail space and overall bulk of accessories mounted on today's modem combat assault rifles or other firearms. Although the mounting member is discussed herein in relation to use with assault rifles, it is within the scope of embodiments that the mounting member or low profile mount may be utilized in connection with any type of firearm known to those skilled in the art. Furthermore, although the mounting member is discussed herein in relation to mounting to a rail or rail system, it may instead be mounted directly or indirectly to another portion or the firearm.

Specifically referring to FIGS. 1-5, a mounting member 10 (which may be a low profile mounting member) or low profile mount is shown. FIGS. 2-5 also depict a rail 20 or rail system of a firearm such as, for example, an assault rifle. The mounting member 10 is attachable to the rail 20 of the firearm and may be detachable from the rail 20 of the firearm.

Figure 3:
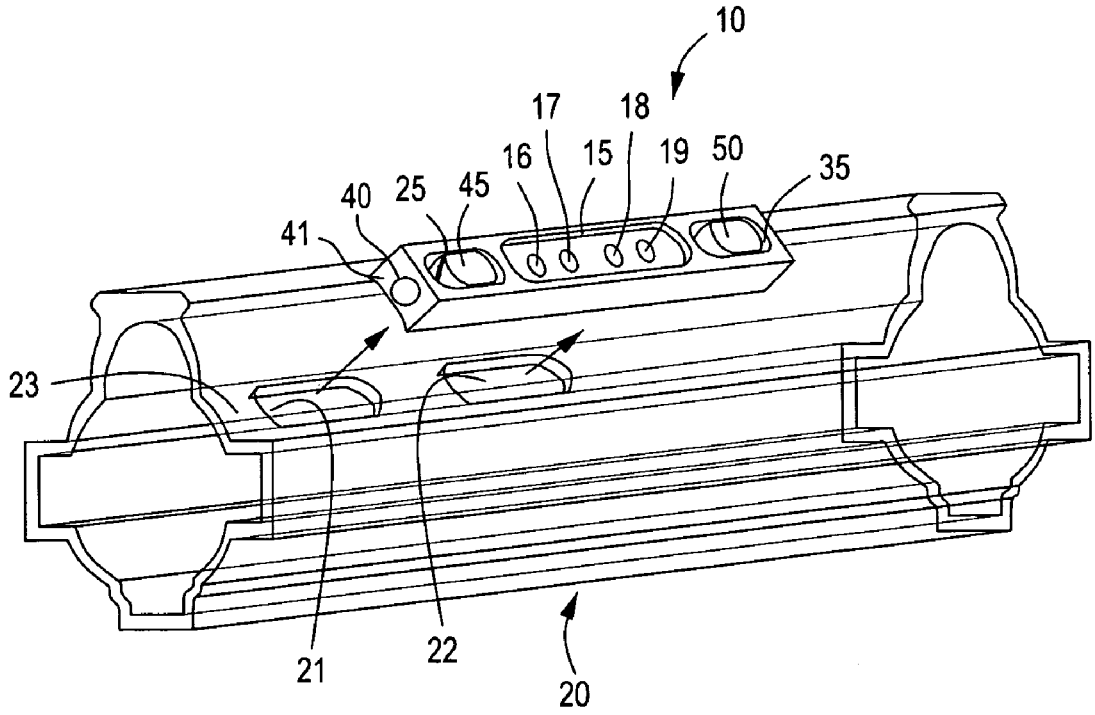
FIG. 3 is a perspective view of the mounting member of FIG. 1 and a rail or rail system.
Figure 4:
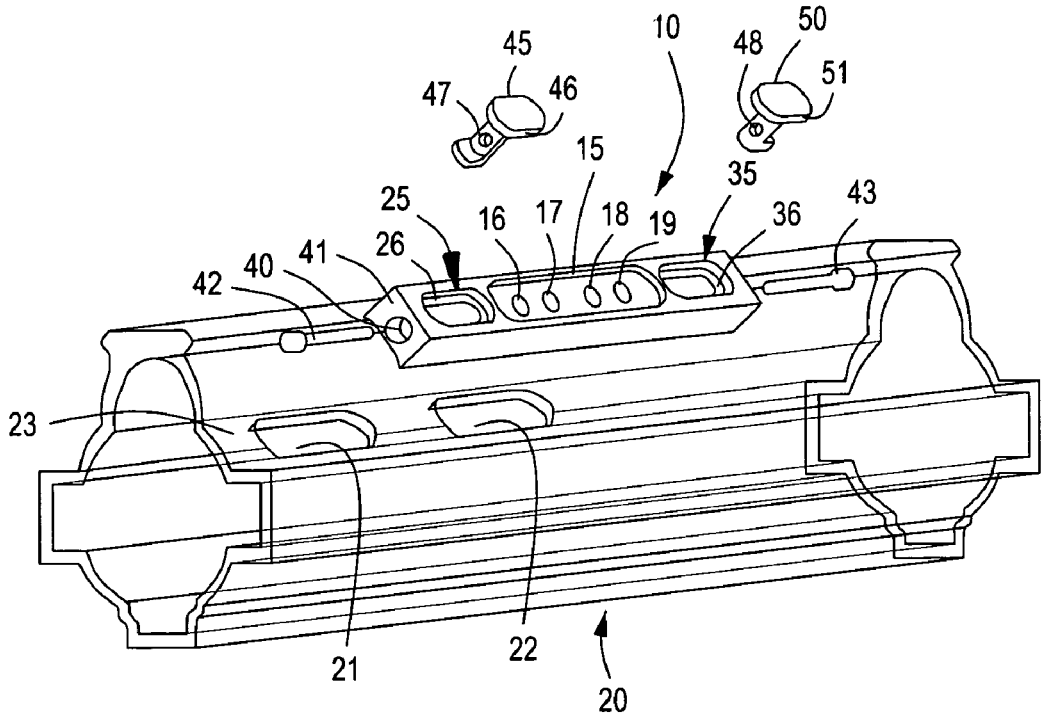
FIG. 4 is an exploded view of the mounting member and associated parts of FIG. 1 and a rail or rail system.

The rail 20 may include spaced apart ventilation holes 21 and 22 (see FIGS. 3 and 4). The holes 21 and 22 may be disposed through a recessed portion 23 of the rail 20, e.g., between rail sides or rail walls. The mounting member 10 may be connectible and/or removable from the holes 21 and 22.

The mounting member 10 may include an elongated body having a first end 11 and a second, opposite end 12 and may be generally rectangular in shape as shown in FIGS. 1-5. Of course, any other shapes of mounting members 10 are contemplated by the present inventors. In some embodiments, the mounting member 10 is constructed from a rigid or generally solid material such as, for example, a metal such as aluminum and/or steel. However, the mounting member 10 may be constructed from any other material known to those skilled in the art on which an accessory is capable of mounting with sufficient stability. The mounting member 10 may be machined out of solid stock material or may be made by any other method known to those skilled in the art for constructing a generally solid mounting member 10 on which one or more accessories are capable of mounting. Any dimensions for the mounting member 10 which facilitate mounting of one or more accessories thereon are contemplated by the inventors of the present invention. Although not intended to be limiting of embodiments, in one embodiment, the length of the mounting member 10 may be approximately 3.5 inches, the width of the mounting member 10 may be approximately 0.5 inches, and the height of the mounting member 10 may be approximately 0.5 inches.

The mounting member 10 may include a recessed portion 15 and first and second apertures or holes 25 and 35 therethrough. Although two apertures 25, 35 are shown through the mounting member 10, it is within the scope of embodiments that any number of apertures may be included through the mounting member 10, including one or more apertures. In the exemplary embodiment shown, the recessed portion 15 is disposed between the first aperture 25 and second aperture 35, although any other arrangement of these portions of the mounting member 10 is also contemplated by the inventors.

As best shown in FIG. 4, the first aperture 25 and second aperture 35 may each optionally include a beveled portion therein to form a first seat 26 in the first aperture 25 and a second seat 36 in the second aperture 35, each seat 26, 36 for retaining a connecting member or fastening member (described below) in its respective aperture 25, 35.

Figure 2:
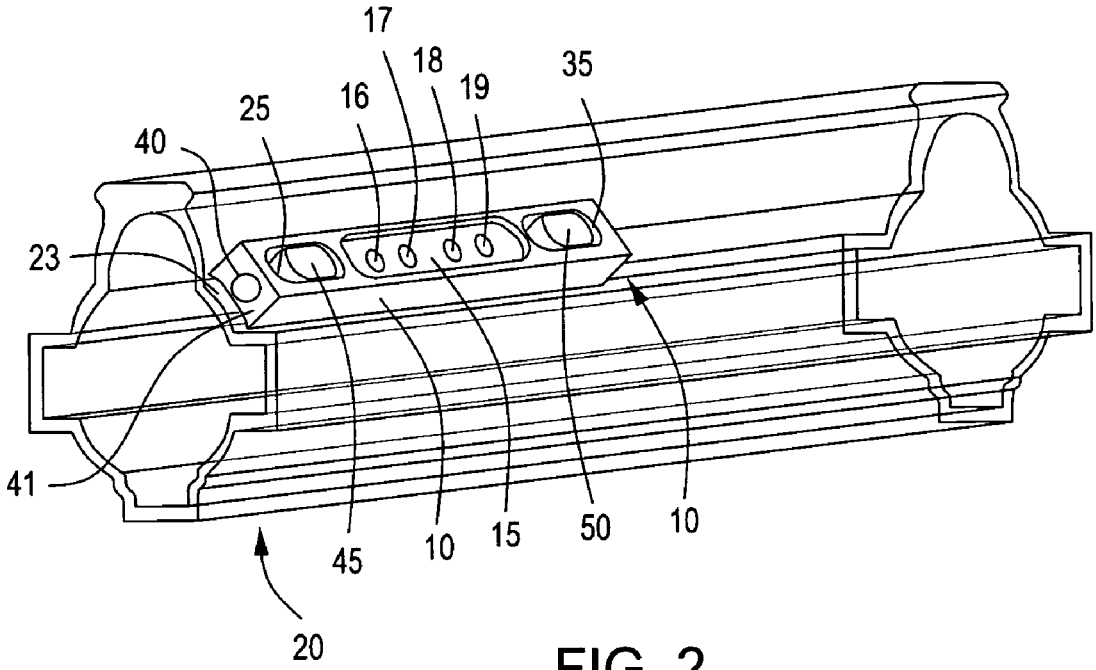
FIG. 2 is a perspective view of the mounting member of FIG. 1 operatively connected to a rail or rail system.

Disposed within the recessed portion 15 are one or more apertures through the mounting member 10 through which one or more connecting members or fastening members (described below) may be disposed. Shown in the embodiment of FIGS. 2-4 are four apertures or holes longitudinally disposed along the recessed portion 15, including a first aperture 16, second aperture 17, third aperture 18, and fourth aperture 19. Any number of apertures through the mounting member 10 may be disposed within the recessed portion 15, including any number from one aperture to a plurality of apertures, as the embodiment shown in FIGS. 1-5 is only exemplary of some embodiments. In an alternate embodiment, the recessed portion 15 is omitted, and the one or more apertures 16, 17, 18, 19 are disposed through the mounting member 10 without the existence of the recess.

The apertures 25 and 35 are preferably generally parallel to and aligned with the one or more apertures 16, 17, 18, and 19 to form longitudinally spaced holes through the mounting member 10. In other words, central axes through each of the apertures 25, 35, 16, 17, 18, and 19 are preferably generally aligned with and parallel to one another.

A first side aperture 40 is disposed through a first side panel 41 at the first end 11 of the mounting member 10, while a second side aperture (not shown) is disposed through a second side panel (not shown) at the second end 12 of the mounting member 10. The first and second side panels 41 and (not shown) may be disposed generally parallel and in line with one another. The second side panel (not shown) and second side aperture (not shown) may generally be mirror images of the first side panel 41 and the first side aperture 40. However, it is also within the scope of embodiments that the side panels are not aligned with one another and/or may be of different dimensions from one another, and that the side apertures are not mirror images of one another and/or include different dimensions from one another. (It is also within the scope of alternate embodiments that the sides may not be panels.) The side apertures 40 and (not shown) may be disposed generally perpendicular to the apertures 25, 35, and 16-19, so that central axes of the side apertures 40 and (not shown) are generally perpendicular to central axes through the apertures 25, 35, and 16-19. In some embodiments, the first side aperture 40 extends from the first side panel 41 to the first aperture 25, while the second side aperture (not shown) extends from the second side panel (not shown) to the second aperture 35.

Figure 5:
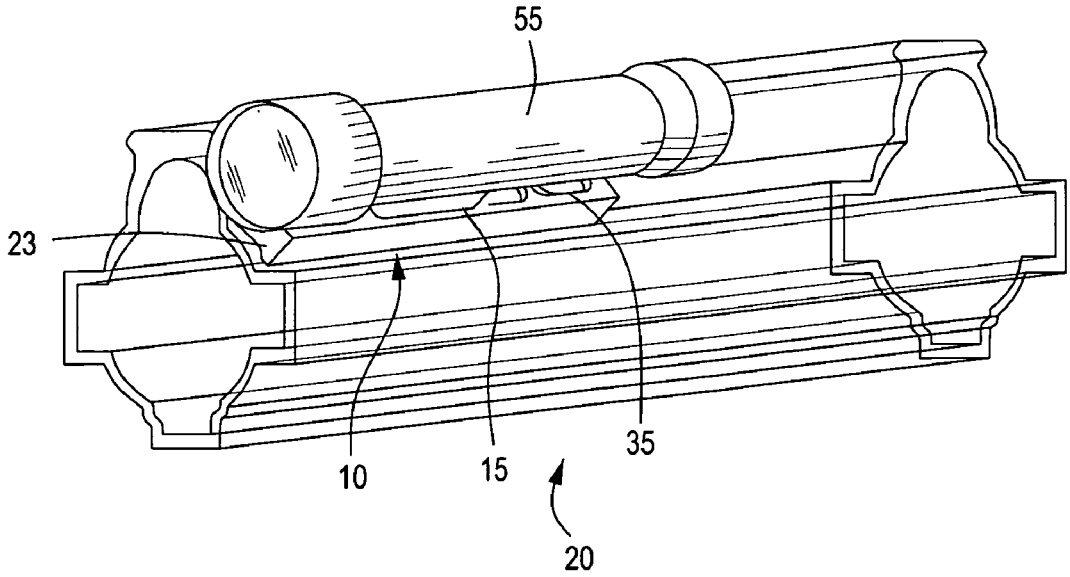
FIG. 5 is a perspective view of an accessory operatively attached to the mounting member of FIG. 1.

FIGS. 2 and 5 illustrate the mounting member 10 attached to the rail 20. FIG. 4 is an exploded parts diagram of the mounting member 10, rail 20, and exemplary connecting members for attaching the mounting member 10 and rail 20 to one another.

A first connecting member 45 and a second connecting member 50 may be utilized to operatively attach the mounting member 10 and the rail 20 to one another. In FIG. 2, the first connecting member 45 is shown disposed through the first aperture 25 and the hole 21, while the second connecting member 50 is shown disposed through the second aperture 35 and the hole 22. In one exemplary embodiment, the first and second connecting members 45 and 50 are J-hook members having a shoulders 46 and 51 for resting on the seats 26 and 36 of their respective apertures 25 and 35 as well as an optional aperture 47, 48 through each J-hook member which is generally aligned with the respective shoulders 46, 51. The first connecting member aperture 47 is designed to mate with the first side aperture 40, and the second connecting member aperture 48 is designed to mate with the second side aperture (not shown). The J-hook members may include J-hooks at their lower ends for hooking around the holes 21, 22 when placed in a position for connecting the mounting member 10 and rail 20 to one another. Although J-hook members are utilized in the shown embodiment, any connecting members or fastening members known to those skilled in the art which are capable of connecting the mounting member 10 to the rail 20 via apertures or holes may be used as connecting members 45, 50 in lieu of the J-hook members. Instead, any other connecting members or means known to those skilled in the art may be utilized to connect the mounting member 10 to the rail 20.

A first retaining member 42 may be disposed through the first side aperture 40 and the aperture 47 through the first connecting member 45, and a second retaining member 43 may be disposed through the second side aperture (not shown) and the aperture 48 through the second connecting member 50. The retaining members 42, 43 serve to retain their respective connecting members 45, 50 in position within their respective apertures 25, 35. In one exemplary embodiment, the retaining members 42, 43 may be threaded fasteners (for example screws), although any connecting members or fasteners capable of retaining the connecting members 45, 50 within their respective apertures 47, 48 known to those skilled in the art may be utilized in lieu of threaded fasteners.

In FIG. 5, a flashlight 55 is shown mounted to the mounting member 10, the mounting member 10 being operatively attached to the rail 20. The flashlight 55 represents any type of accessory for mounting on the mounting member 10. Exemplary accessories which may be utilized in lieu of one or more flashlights are one or more bipods, one or more variations of a grip system, one or more laser modules, one or more switches for actuate lasers and/or lights, and/or any other accessories which are desired to be mounted to a firearm.

In operation, the mounting member 10 is positioned on the rail 20 so that its lower face directly or indirectly contacts the rail 20. To position the mounting member 10 on the rail 20, the first aperture 25 is generally aligned with the first hole 21 of the rail 20, and the second aperture 35 is generally aligned with the second hole 22 of the rail 20 (of course, in an alternate embodiment, the first aperture 25 may instead by aligned with the second hole 22, and the second aperture 35 may be aligned with the first hole 21). The first connecting member 45 is then placed through the first aperture 25 and the hole 21, and the second connecting member 50 is disposed through the second aperture 35 and the hole 22. In one embodiment where the connecting members 45, 50 are J-hook members, the "hook" of the "J" may be disposed as shown in FIG. 4, where the first connecting member 45 hook points toward the first end 11 of the mounting member 10 and the second connecting member 50 hook points toward the second end 12 of the mounting member 10.

The aperture 47 of the first connecting member 45 is generally aligned with the first side aperture 40 of the mounting member 10, and the aperture 48 through the second connecting member 50 is generally aligned with the second side aperture (not shown) of the mounting member 10. This alignment allows the retaining members 42 and 43 to retain their respective connecting members 45, 50 within the mounting member 10. Specifically, the first retaining member 42 is disposed within the first side aperture 40 and through the aperture 47 in the first connecting member 45, and the second retaining member 43 is disposed within the second side aperture (not shown) and through aperture 48 through the second connecting member 50.

At this point in the operation, the mounting member 10 is secured to the rail 20. A user may then position the one or more accessories, such as the flashlight 55, on the mounting member 10 and easily connect the one or more accessories to one or more of the apertures 16, 17, 18, and/or 19 through the mounting member 10 via one or more connecting members such as one or more fasteners, e.g., one or more threaded machine screws. Any other connecting members or connecting means known to those skilled in the art may be utilized in lieu of or in addition to screws or fasteners.

In some embodiments, the mounting member 10 rests entirely below the surrounding rail 20 surfaces (e.g., the side surfaces or wall(s)) when mounted to the rail system 20, therefore giving it a lower profile than the rail system 20; thus, the mounting member 10 may be a low profile mount. However, it is also within the scope of embodiments that the mounting member 10 may instead be flush or generally flush with the surrounding rail 20 surfaces when mounted or higher than the surrounding rail 20 surfaces when attached to the rail system 20.

Alternate connecting, fastening, and retaining members, methods, and means known to those skilled in the art may be utilized in lieu of the connecting members, fastening members, fasteners, and/or retaining members described above, including but not limited to slides, threaded holes, and/or other mounting fixtures suited to securing members to one another. The mounting member 10 may be secured to the rail 20 by other connecting, fastening, and retaining members, methods, and means known to those skilled in the art such as for example rivets, nuts, and/or bolts which may be made from plastic, stainless steel, hardened steel, and/or an other suitable material.

Figure 6:
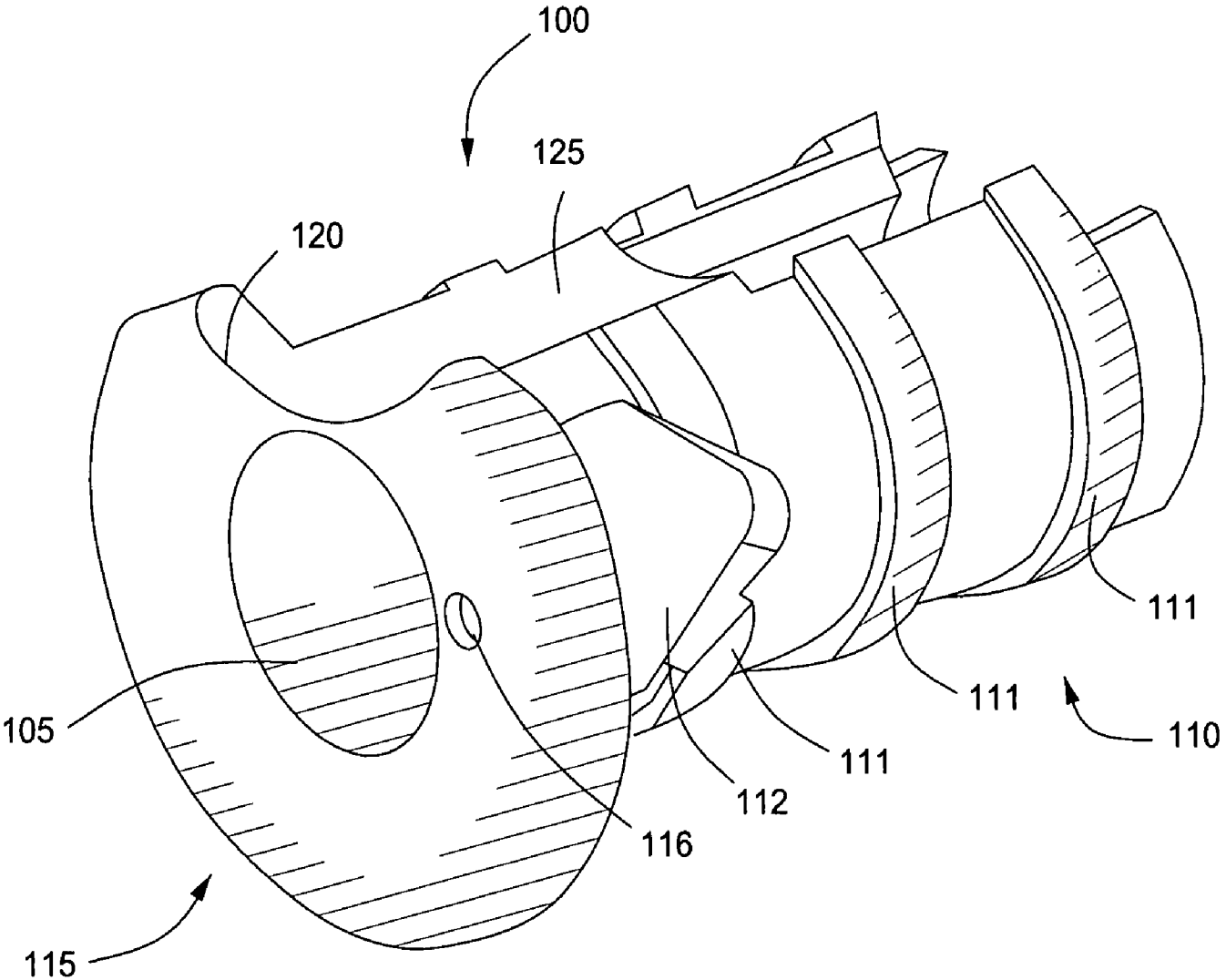
FIG. 6 is a perspective view of an embodiment of a foregrip.
Figure 7:
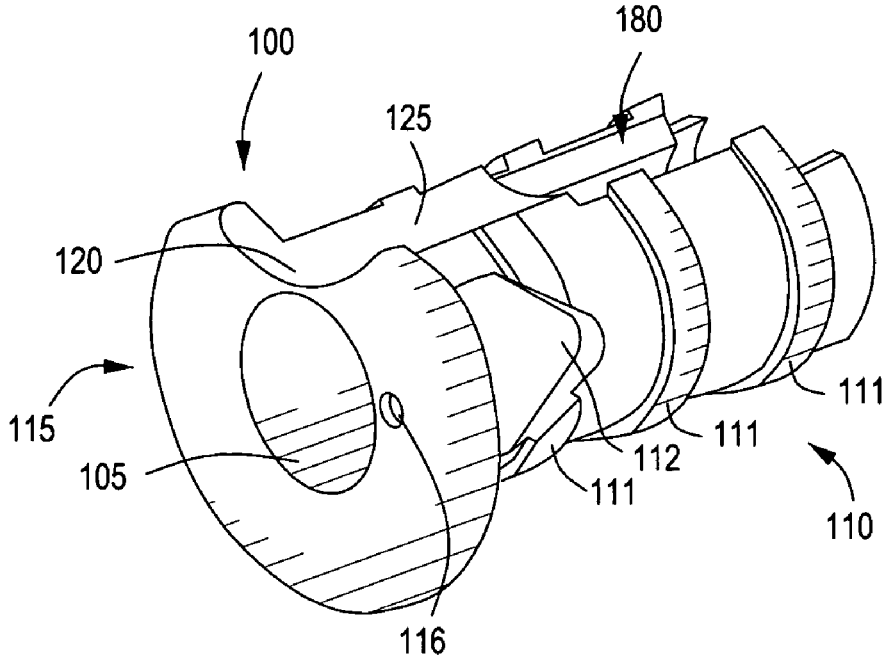
FIG. 7 is a perspective view of the foregrip of FIG. 6.
Figure 8:
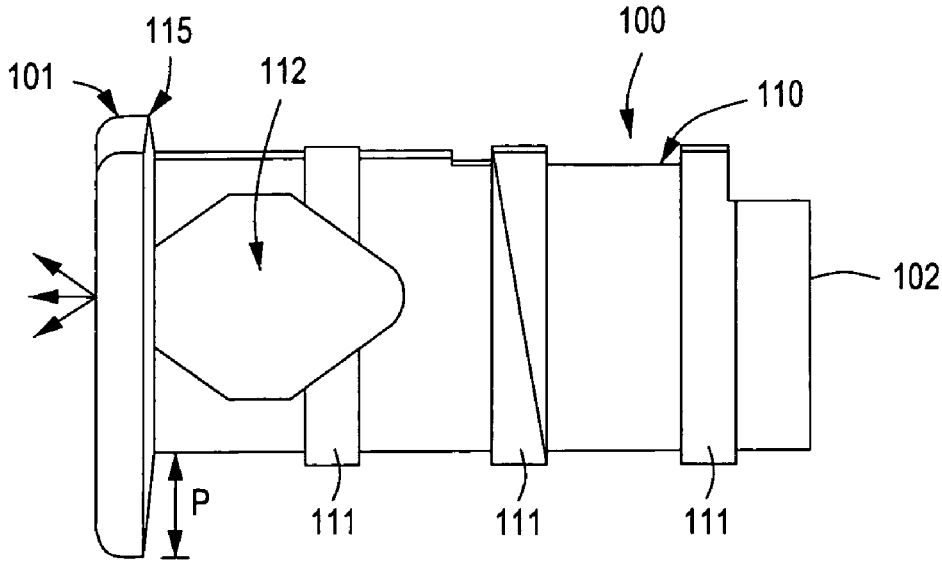
FIG. 8 is a side view of the foregrip of FIG. 6.

FIGS. 6-8 depict an embodiment of a firearm foregrip with finger guard. Modern day breaching shotguns are often extremely short in length, which brings the position of the hand even closer to the end of the barrel. A foregrip is attached to the charging mechanism of the shotgun. In order to extract a spent cartridge and chamber a new cartridge, one would charge or pull back the foregrip to the rear, ejecting the spent cartridge, then push forward the foregrip, chambering a new cartridge. This action is also referred to as a pump action.

Embodiments provide a platform herein referred to as a "shotgun foregrip" that may use a flared or walled end piece design which protects an individual's finger(s), hand(s), and/or other body parts. This flared or walled end piece may be a catch or stop that substantially exceeds the diameter of the foregrip itself, thereby stopping the fingers from slipping past the foregrip and landing in front of the barrel. The shotgun foregrip may have different patterns and textures to enhance grip and feel. In one embodiment, the shotgun foregrip accepts a low power light source used for low light illumination required to identify a target in tactical situations. In addition, in embodiments, the shotgun foregrip may be configured to present a relatively low-profile protrusion from the physical surface of the shotgun itself and mount standardized optional accessories.

A benefit of this foregrip is that it may be added to already-manufactured breaching or other shotgun or firearm systems. If necessary or desired, modified fasteners may be provided to secure the flared or walled end piece to existing foregrips and rail systems, avoiding the need for a complete and total replacement of other shotgun foregrips.

The shotgun foregrip with finger guard is a solution for ultra-short breaching shotguns carried today. Although the foregrip is discussed above in relation to use with shotguns, it is within the scope of embodiments that the foregrip may be utilized in connection with any type of firearm known to those skilled in the art.

Referring now to FIGS. 6-8, a foregrip member 100 of embodiments is illustrated. The foregrip member 100 is preferably a tubular body of generally circular cross-section to attach to a bore through a firearm, although any cross-sectional and body shapes are within the scope of alternate embodiments. The tubular body of the foregrip member 100 includes a longitudinal bore 105 therethrough for mating with the bore (not shown) through the firearm such as the charging mechanism. The bore 105 may extend the entire length of the foregrip member 100.

The foregrip member 100 includes a first end 101 and a second end 102, and the bore 105 may extend from the first end 101 to the second end 102. The foregrip member 100 includes a gripping portion 110 and a guarding portion 115. The gripping portion 110 and guarding portion 115 may either be molded from the same material or may instead be operatively or directly attached to one another via any connecting or fastening member(s) or any other means or methods known to those skilled in the art for attaching members to one another. If the gripping portion 110 and guarding portion 115 are separate pieces attached to one another via fastening member(s) or methods, the bore 105 is formed by generally aligning central axes through respective bores through the gripping portion 110 and guarding portion 115.

The gripping portion 110 may be a generally tubular body having a longitudinal bore (part of bore 105) running therethrough. In some embodiments, an inner diameter of the gripping portion 110 is generally uniform and smooth, while an outer diameter of the gripping portion 110 optionally includes one or more gripping members 111 longitudinally spaced apart along the outer diameter of the gripping portion 110. The one or more gripping members 111 allow the user to more effectively grip the foregrip member 100 and firearm and prevent slipping of the user's hand(s) or finger(s) in front of the foregrip member 100 (thereby increasing the safety of the firearm). The one or more gripping members 111 may include in some embodiments raised ribbed portions or ribs disposed along the outer diameter of the gripping portion 110, each ribbed portion increasing the outer diameter of the gripping portion 110 at the location of the ribbed portion. The gripping members 111 may be molded with the gripping portion 110 or operatively attached thereto.

The gripping portion 110 may optionally include a recessed portion 112 or cutout in which one or more lighting mechanisms such as an LED light may be located. It is within the scope of embodiments that any type of lighting mechanism known to those skilled in the art may be mounted in the recessed portion 112 and that the lighting mechanism is not limited to LED light.

The guarding portion 115 preferably possesses a larger outer diameter than the outer diameter of the gripping portion 110 so that a protrusion P or stop shoulder is formed to prevent a user's hands or fingers from slipping in front of the barrel. In some embodiments, the guarding portion 115 outer diameter extends a range of from approximately 0.5 inches to approximately 0.75 inches from the gripping portion 110 outer diameter (protrusion P distance) so that the protrusion P distance of the wall prevents a user's fingers or hands from slipping around the wall. However, other wall protrusion P distances are within the scope of embodiments, and the distances disclosed herein are not limiting of embodiments. The guarding portion 115 may optionally include an aperture 116 therethrough which allows light from the lighting mechanism disposed within the recessed portion 112 to travel through the aperture 116 to provide illumination, preferably low light illumination, for example for tactical operations.

A cutout 180 may optionally be disposed in an upper surface of the gripping portion 110 as shown to fit the foregrip 100 to the shotgun or other firearm.

A portion of the outer diameter of the gripping portion 110 and a portion of the outer diameter of the guarding portion 115 preferably possess cooperating, longitudinally disposed recesses along their lengths. These recesses include a first recess 120 in the guarding portion 115 as well as a second recess 125 in the gripping portion 110. The recesses 120 and 125 are preferably aligned with one another for optionally supporting a barrel of a firearm thereon. These recesses 120 and 125 are preferably disposed at an uppermost location on the firearm when the firearm is in the firing position for expending ammunition.

In operation, the foregrip 100 is manufactured as either one piece or by attaching the gripping portion 110 and the guarding portion 115 to one another. The foregrip 100 is operatively attached to a firearm's charging mechanism (at or near its charging end) at or near the second end 102 of the foregrip 100 using one or more connecting or fastening members or mechanisms known to those skilled in the art.

When the foregrip 100 is attached to the firearm, the user may grip the gripping portion 110 of the foregrip 100. The gripping members 111 on the gripping portion 110 provide frictional means for preventing the user's hands and/or fingers from sliding along the gripping portion 110 in front of the guarding portion 115. Additionally, the guarding portion 115 acts as a stop or catch, further preventing the user's hands and/or fingers from sliding in front of the guarding portion 115. The guarding portion 115 is preferably of sufficiently greater outer diameter than the outer diameter of the gripping portion 110 to act as a stop or catch for the user's fingers and/or hand.

The foregrip 100 may also be easily removable from the firearm along with being easily attachable to the firearm. In an alternate embodiment, the foregrip 100 may be molded or otherwise generally permanently attached to the firearm.

In an alternate embodiment, the guarding portion 115 may be secured to an existing foregrip or rail system of a firearm by one or more connecting or fastening members or means known to those skilled in the art, which may include one or more modified fasteners. This alternate embodiment allows protection of a user's hands and fingers without complete replacement of a typical firearm foregrip.

While the foregoing is directed to embodiments of the present invention, other and further embodiments of the invention may be devised without departing from the basic scope thereof, and the scope thereof is determined by the claims that follow.

The invention claimed is:

1. A mounting member for attaching one or more accessories to a firearm, comprising:

a body having a first end and a second end;

one or more connecting portions capable of releasably connecting the mounting member to one or more ventilation holes through a rail of the firearm, wherein the one or more connecting portions comprise:

a first aperture proximate the first end and a first connecting member for connecting the first aperture and the first ventilation hole through the rail; and a second aperture proximate the second end and a second connecting member for connecting the second aperture and the second ventilation hole through the rail;

an accessory connecting portion to which one or more firearm accessories are capable of attaching; and a retaining portion for retaining the first connecting member within the first aperture, wherein the retaining portion comprises a first side aperture through a side face of the body and a first retaining member disposed within the first side aperture and through the first connecting member, wherein central axes of the first side aperture and the first aperture are generally perpendicular to one another, wherein the first connecting member comprises a J-hook member having a hole therethrough, a central axis of the hole through the J-hook member being generally aligned with the first side aperture when the J-hook member is disposed within the first aperture.

2. The mounting member of claim 1, wherein the first retaining member is a screw fastener.

* * * * *